United States Patent [19]

Terrell et al.

[11] Patent Number: 4,491,178

[45] Date of Patent: Jan. 1, 1985

[54] THROUGH TUBING BRIDGE PLUG

[75] Inventors: Jamie B. Terrell; Donna K. Pratt, both of Fort Worth, Tex.

[73] Assignee: Gearhart Industries, Inc., Fort Worth, Tex.

[21] Appl. No.: 522,129

[22] Filed: Aug. 11, 1983

[51] Int. Cl.[3] ..... E21B 33/134

[52] U.S. Cl. ..... 166/192; 166/135; 166/285; 166/202

[58] Field of Search ..... 166/192, 135, 285, 202, 166/133; 405/269, 244; 138/89

[56] References Cited

U.S. PATENT DOCUMENTS

| | | | |
|---|---|---|---|
| 2,211,478 | 8/1940 | Pierce | 299/21 X |
| 2,929,455 | 3/1960 | Godbey | 166/202 X |
| 3,891,034 | 6/1975 | Owen et al. | 166/202 X |

*Primary Examiner*—Stephen J. Novosad
*Assistant Examiner*—Michael Starinsky
*Attorney, Agent, or Firm*—Richards, Harris & Medlock

[57] ABSTRACT

A bridge plug for use in plugging a well at a subterranean location and adapted to be set in place by insertion through a tubing string. The bridge plug comprises an elongated vent tube supporting upper and lower petal basket structures, each of which comprises a plurality of petal leaves movable between a retracted position and an expanded position. In the expanded positions the petal leaves for the upper and lower baskets form conical configurations which face upwardly and downwardly respectively. Upper and lower fabric bags cover the respective petal basket structures respectively and extend over the inner and outer surfaces of the petal leaves. Each of the petal basket structures are further provided with conically shaped liners formed of an impermeable material inside the bags and interposed between the inner surfaces of the petal leaves and the conforming portions of the bags. The liners may be formed of an adhesion-resistant material such as fiberglass fabric coated with a polytetrafluoroethylene.

8 Claims, 7 Drawing Figures

THROUGH TUBING BRIDGE PLUG

DESCRIPTION

1. Technical Field

This invention relates to a bridge plug for plugging a well at a subterranean location and more particularly to a vented through-tubing bridge plug having an improved packer assembly.

2. Background of the Invention

There are various applications in which it is desirable to selectively place a downhole plug within a well. For example, in oil and/or gas producing wells, it is frequently necessary to plug off a lower producing formation while operating the well to recover petroleum fluids from an upper formation. Often times, after the well is completed with tubing in place, it is desirable to place the plug in the well without first withdrawing the tubing string. This can be accomplished through the use of the so-called "through tubing" bridge plugs which are run through the tubing to the desired location within the well.

A particularly effective through-tubing bridge plug is disclosed in U.S. Pat. No. 3,891,034 to Owen et al. In this system, the bridge plug is run into the well in a carrying tube which is of a sufficiently small diameter to pass through the tubing. When the desired depth is reached, an explosive release mechanism is fired which allows a spring-biased thrust mechanism to force a set of lower gripping dogs out the bottom of the tube. The dogs hold the bridge-plug assembly in place while the cover tube is withdrawn by reeling in the wire line.

The bridge plug includes a vent tube equipped with upper and lower petal baskets which function as packers. Each of the petal baskets comprises a plurality of fan-shaped petal leaves which are mounted on spring members and are biased outwardly so that they automatically open as the cover tube is withdrawn from the vent tube and packer assembly. In the expanded position, the petal leaves of the upper basket or packer form an upward-facing conical configuration and the leaves of the lower basket form a downward facing conical configuration. A fabric bag is disposed over both sides of the leaves of the upper and lower baskets and has cuffed portions at each end which fit closely around the vent tube. The upper basket is adapted to receive a sand pack and/or cement slurry which can be lowered into the well by means of a suitable "dump bailer" after the bridge plug has been set. The upper-packer bag is permeable to water so as to allow water to seep from the cement slurry to effect a better setting of the cement. The lower packer functions to direct fluids into and through the vent tube to avoid fluid flow adjacent the casing which may adversely effect the cement slurry set above the upper basket. The bag about the lower packer or petal basket may be permeable or impermeable.

DISCLOSURE OF THE INVENTION

In accordance with the present invention, there is provided a new and improved through-tubing bridge plug assembly of the type comprising an elongated vent tube and upper and lower petal basket structures, each having a plurality of petal leaves movable between retracted and expanded positions as described previously. In the expanded position, the leaves of the upper petal basket are in a upward-facing conical configuration, and the leaves of the lower petal basket are in a downward facing conical configuration. A fabric bag covers at least one of the petal baskets and a flexible conically shaped liner formed of an impermeable material is located inside of the bag. The impermeable liner is interposed between the inner surfaces of the petal leaves and the conforming portion of the bag. Preferably each of the petal baskets is provided with a bag and liner assembly and the liner is formed of an adhesion-resistant material.

BEST MODES FOR CARRYING OUT THE INVENTION

Figure 1:
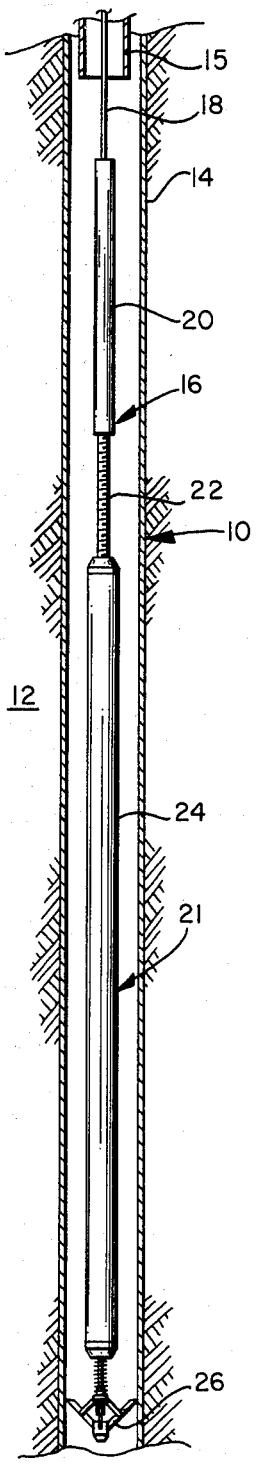
FIG. 1 is a side elevational view, partly in section, showing a through-tubing bridge plug within a cased well bore in a partially activated position.

Turning first to FIG. 1, there is illustrated a well bore 10 which extends from the surface of the earth (not shown) into a subterranean formation 12. The well bore is equipped with an outer conduit or casing string 14 which normally will be cemented to the surrounding earth formation by means of a cement sheath (not shown). A tubing string 15 is suspended in the well from the well head (not shown) at the earth's surface. A running-in tool 16 for the bridge plug assembly incorporating the present invention is suspended in the well by means of a cable 18. The cable is a conventional wire line cable which includes an internal electrical conductor through which a firing signal may be applied from the surface to the well tool. The well tool comprises a locator and release section 20 and a cover-tube section 21. The two sections are connected by means of a threaded member 22 which serves as a jack screw to facilitate assembly of the tool prior to insertion into the well bore.

The locator and release section 20 includes a cable head, a casing collar locator, and a dog-release assembly which functions to initiate the projection of a primary set of dogs out the bottom end of the covertube section. The cover tube section includes a cover tube 24 within which is mounted a thrust mechanism for projecting the primary dogs out of the cover tube and a closure rod upon which is mounted an upper centralizer assembly and a vent plug assembly. The vent plug assembly includes a vent plug which fits into the upper end of a vent tube which carries upper and lower petal baskets. A dog assembly comprising lower primary dogs and upper secondary dogs is secured to the bottom of the vent tube and packer assembly.

In setting the bridge plug, the tool 16 is run through the tubing 15 to the desired location. An explosive stud forming part of the dog release assembly is detonated to allow expansion of a thrust spring which functions to force the remainder of the tool downwardly with respect to the cover tube 24, thus forcing the primary dog assembly out of the bottom of the cover tube. The dogs of the primary dog assembly 26 are spring biased outwardly into engagement with the casing 14 as illustrated in FIG. 1. Thereafter, the cover tube 24, along with sections 20 and 22, is pulled from the remainder of the bridge-plug assembly by withdrawing the wire line cable 18 from the well. As the cover tube is withdrawn, the secondary dog assembly and the lower and upper petal basket packers are released and biased outwardly to their expanded positions. Finally, as the cover tube is completely withdrawn from the bridge plug assembly, an upper centralizer assembly is also biased outwardly to the expanded position to further centralize the bridge plug assembly within the casing. For a further description of the running-in-tool and the manner in which the bridge plug is initially run into and set within the well, reference is made to the aforementioned U.S. Pat. No. 3,891,034 to Owen et al, the disclosure of which is incorporated herein by reference.

Figure 2:
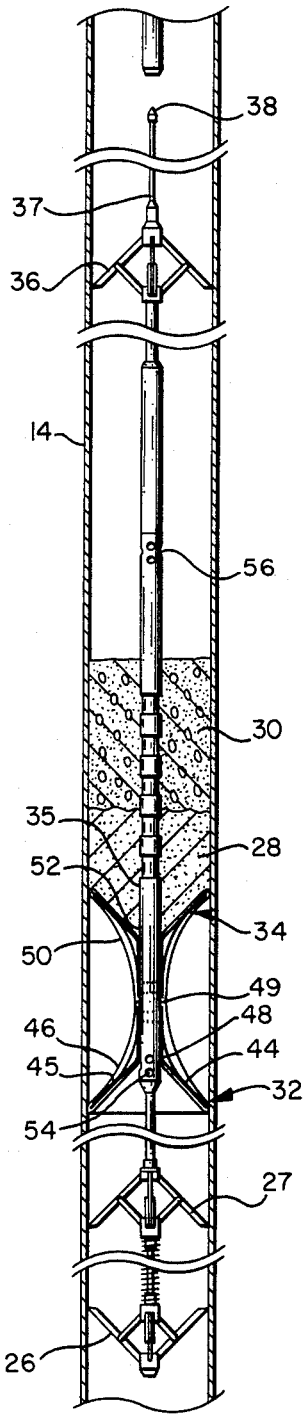
FIG. 2 is a side elevational view, partly in section, illustrating a bridge plug assembly in place within the well with a sand and cement seal on the upper petal basket member.
Figure 3:
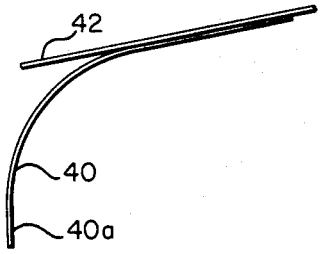
FIG. 3 is a side view of a petal-basket leaf assembly.
Figure 4:
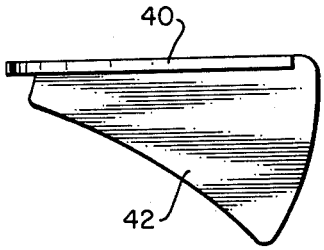
FIG. 4 is a plan view of the assembly shown in FIG. 3.

Turning now to FIG. 2, there is illustrated a side elevational view of the bridge plug assembly in place within the well and with the upper petal basket structure provided with an initial bed of sand 28 upon which is disposed a cement plug 30. The bridge plug comprises the primary and secondary dog assemblies 26 and 27, respectively, lower and upper petal basket structures 32 and 34 mounted on a vent tube 35, an upper centralizer assembly 36 and a closure rod 37 which terminates in a retrieving knob 38. The petal baskets are formed of fan-shaped leaves which are mounted on outwardly-biased spring members so that they are automatically moved to the expanded position upon withdrawal of the cover tube from the packer structures. A petal basket leaf with its associated spring member is shown in FIGS. 3 and 4. FIG. 3 is a side elevational view of a spring member 40 in the expanded position and showing the side of the petal leaf 42 supported on the spring member. FIG. 4 is a plan view of the petal leaf 42 amd spring member 40. Returning now to FIG. 2, the lower petal basket comprises a plurality of petal leaves, e.g., 10 in number, of which two leaves indicated by reference numbers 44 and 45 are shown. These leaves are supported on their respective spring members which, in turn, are secured at their upper ends to the vent tube 35 by any suitable means such as by brads or screws. The lower petal basket, when in the expanded position shown, forms a downward facing conical configuration.

Figure 6:
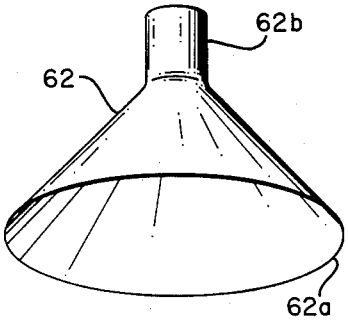
FIG. 6 is a perspective view of an impermeable liner employed in the present invention.
Figure 5:
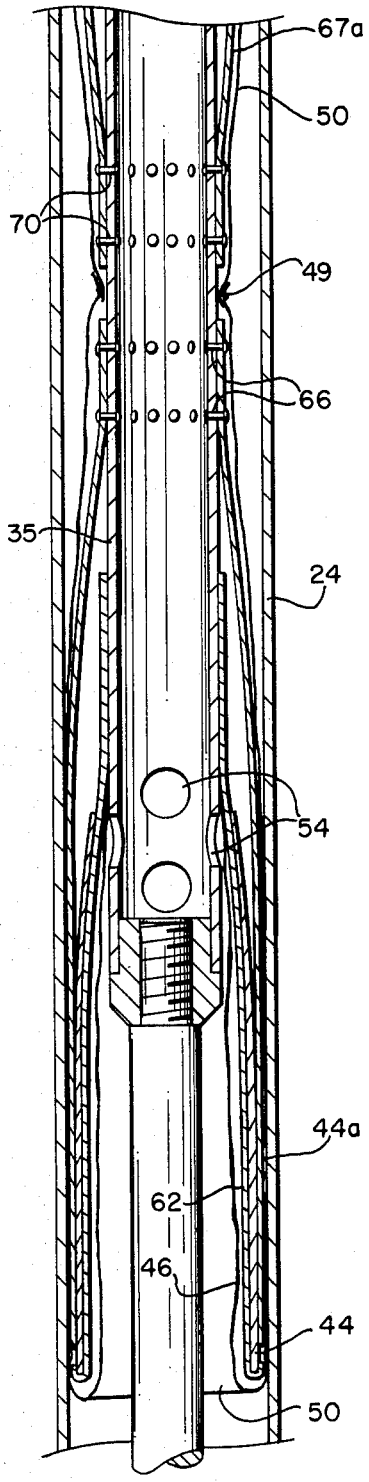
FIG. 5 is a side elevation view, partly in section, illustrating a portion of the vent tube and packer assembly of the present invention in the retracted position prior to removal of the cover tube.

The upper petal basket is formed similarly as the lower petal basket except the upper basket, when in the expanded position shown, forms an upward facing conical configuration. At least one and preferably both of the petal baskets are formed with fabric bags which extend over the inner and outer surfaces of the petal leaves of the respective baskets. In addition, as illustrated in FIG. 2 with the lower petal basket structure 32, the bag 46 folds over the leaves 44 and 45 and is secured to the vent tube by means of ties of nylon wrappings or the like (not shown) at locations 48 and 49. The upper petal basket structure similarly is provided with a fabric bag 50 which is secured to the vent tube at location 52 and extends over the inner surface of the petal leaves to the outer ends thereof and thence over their outer surfaces to the location 49 where it is secured to the vent tube. As noted in the aforementioned patent by Owen et al, it is preferred that at least the upper fabric bag be formed of a water permeable material. In accordance with the present invention, at least one and preferably both of the petal basket structures are also provided with flexible, conically-shaped, impermeable liners, as illustrated in FIGS. 5 and 6 and described in greater detail hereinafter.

In operation of the tool, the bridge plug assembly is set in the configuration shown in FIG. 2. The sand pack 28 and cement plug 30 is set in place and while the cement cures, well fluid flows through the interior bore of the vent tube via apertures 54 and 56. In the normal course of events, the flow of fluid will be from below the bridge plug to above the bridge plug. Thus, fluid, for example, from a lower productive formation, will flow into the vent tube 35 via the lower apertures 54 through the central bore of the tube and then outwardly into the well bore via upper apertures 56. However, in some cases, the flow of fluid may be in the reverse direction, from above to below the bridge plug.

The closure rod 37 forms part of the vent plug assembly (not shown) within the vent tube which functions to close the passageway through the vent tube after the cement plug has set. In operation of this mechanism, a fishing tool or the like is run through the tubing string on a wire line. The fishing tool includes a suitable grasping mechanism, such as a collet finger assembly, which grasps the knob 38. Once the fishing tool is secured to knob 38, an upward tension on the wire line moves the closure rod upward. This activates the vent plug mechanism to move a vent plug (not shown) downwardly past the upper apertures 56, thus shutting off the passageway through the bridge plug assembly. For a further description of the vent plug assembly and its manner of operation, reference may be had to the aforementioned U.S. Pat. No. 3,891,034 to Owens et al.

In accordance with the present invention, at least one of the petal basket structures is provided with a conically-shaped liner formed of an impermeable material. The liner is located inside the bag and interposed between the inner surfaces of the petal leaves and the conforming portion of the bag. Preferably both the upper and lower petal basket structures will be provided with such a liner as described hereinafter. However, if only one liner is employed, it will normally be disposed about the lower petal basket since, in most circumstances, fluid flow will be from below to above the bridge plug assembly.

Figure 7:
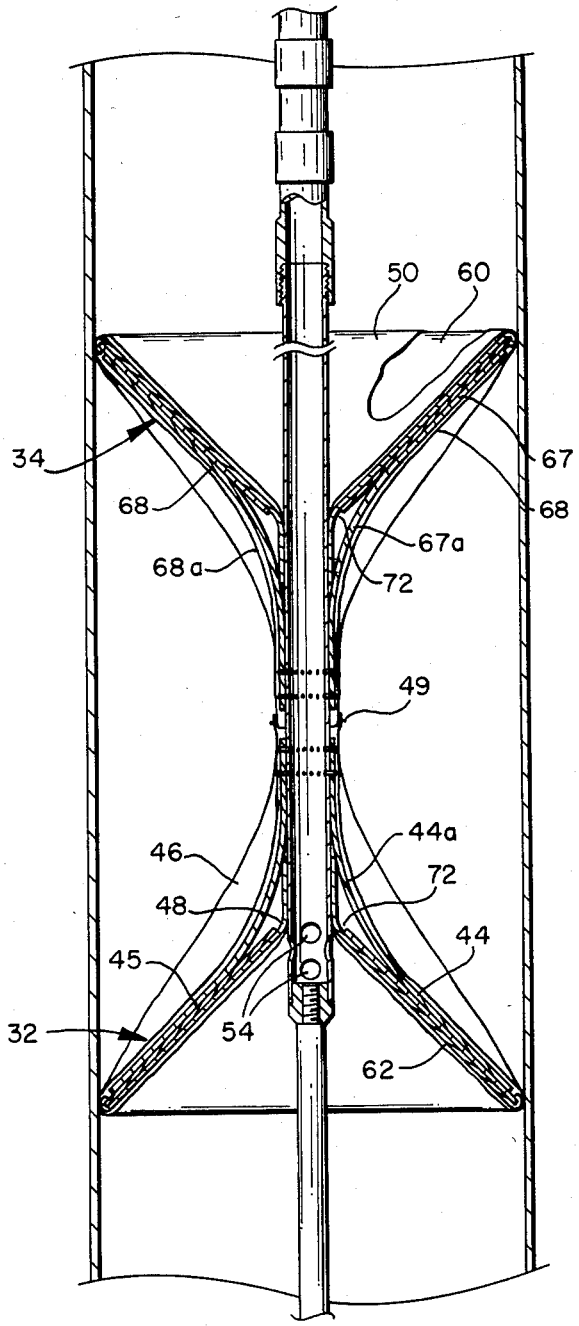
FIG. 7 is a side elevational view, partly in section, showing the upper and lower petal baskets in the expanded position after withdrawal of the cover tube.

Turning now to FIGS. 5 & 7, there is illustrated a sectional view of a portion of the vent tube and packer assembly showing the petal basket structures in the retracted position within the cover tube 24. The upper and lower petal basket structures are provided with flexible, conically-shaped liners 60 and 62, respectively, which, as shown, are disposed between the inner surfaces of the petal leaves and the conforming inner portion of the bag. Thus, with respect to the lower petal basket structure, the liner 62 is disposed between the inner surfaces of leaves 44 and 45 and the conforming inner surface **46*a* of the fabric bag 46. The configuration of liner 62 in the expanded position is drawn in FIG. 6. As there illustrated, the conical configuration provides a funnel mouth at its outer end 62*a* and tapers inwardly to a tubular throat section 62*b* at its inner end. The liner is secured to the vent tube by means of a wrapping of nylon cord or the like around section 62*b*. The liner may be secured to the vent tube 35 coextensively with the bag 46 at location 48 or at another location above ports 54**.

Returning to FIG. 5, the leaf springs 44*a* and 45*a* upon which leaves 44 and 45 are supported and are connected to the vent tube by means of brads or screws 66 inserted through the springs and the appropriate aperatures in the vent tube. The leaf springs 67*a* and 68*a* of the upper basket structure are secured to the vent tube 35 by means of fasteners 70 inserted through the appropriate apertures. The upper conically-shaped liner 60 is disposed in the upper basket structure similarly as the liner 62. The upper and lower bags 50 and 46 overlap at location 49 where they are tied to the vent tube.

The leaves of the petal baskets are secured to their respective spring members so that their inner ends, when in the expanded position, are spaced from the vent tube to provide adequate clearance for the impermeable liners. This lessens the likelihood that abrasion by the inner ends of the petal leaves will rupture the liners.

The conically-shaped liners may be formed of any suitable material which will remain flexible and retain its structural integrity and impermeability to fluids at the conditions normally encountered within well bores. It is preferred that the conically-shaped liners be formed of an adhesion resistant material; that is, a material having good lubricity with respect to the bag and petal leaves. This will alleviate the problems of jamming and the like during withdrawal of the vent tube and expansion of the packer assemblies. The liners may be formed of the fluoroplastics such as polytetrafluoroethylene (Teflon), copolymers of tetrafluoroethylene and hexafluoropropylene and copolymers of ethylene and tetrafluoroethylene. Other suitable materials include trifluoromonochloroethylene polymers available under the trade mark Halon. Fluoroplastics of the type described may be reinforced with flexible materials such as asbestos or fibrous glass or such fluoroplastics may be added in a finely divided form to other plastics in order to provide good lubricity. A particularly suitable liner may be formed of a fiber glass fabric coated with polytetrafluoroethylene.

FIG. 7 illustrates the packer assembly of FIG. 5 with the cover tube removed and the upper and lower petal basket structures in the expanded position within the well bore. As shown, the upper and lower liners 60 and 62 cover the inner surfaces of the petal basket leaves and are secured at their inner ends to the vent tube assembly thus preventing fluid flow from the upper or lower direction through the cement plug (FIG. 2) as it sets. The bag for the upper petal basket structure, preferably, is of a water permeable fabric material so that some water can still drain from the cement through the sand pack and upper bag where it is retained by the liner 60. As shown in FIG. 7, a clearance as indicated by reference number 72 is provided between the inner end of the petal leaves and the vent tube. For example, a spacing of about ½" may be provided.

Having described specific embodiments of the present invention, it will be understood that modifications thereof may be suggested to those skilled in the art, and it is intended to cover all such modifications as fall within the scope of the appended claims.

What is claimed is:

1. A through tubing bridge plug assembly comprising:

(a) an elongated vent tube;

(b) an upper petal basket on said vent tube having a plurality of petal leaves movable between a retracted position about said vent tube and an expanded position in which said petal leaves are in an upward facing conical configuration;

(c) a lower petal basket on said vent tube having a plurality of petal leaves movable between a retracted position about said tube and an expanded position in which said lower basket leaves are in a downward facing conical configuration;

(d) a fabric bag covering at least one of said petal baskets and extending over the inner and outer surfaces of the petal leaves thereof; and (e) a flexible conically-shaped liner formed of an impermeable material inside said bag and interposed between the inner surfaces of said petal leaves and the conforming portion of said bag.

2. The combination of claim 1 wherein said liner is formed of an adhesion resistant material.

3. The combination of claim 2 wherein said liner is formed of a fiber-glass fabric coated with polytetrafluoroethylene.

4. The combination of claim 1 wherein said liner and said bag are disposed about said lower petal basket.

5. A through tubing bridge plug assembly comprising:

(a) an elongated vent tube;

(b) an upper petal basket on said vent tube having a plurality of petal leaves movable between a retracted position about said vent tube and an expanded position in which said leaves are in an upward facing conical configuration;

(c) a lower petal basket on said vent tube having a plurality of petal leaves movable between a retracted position about said tube and an expanded position in which said lower basket leaves are in a downward facing conical configuration;

(d) upper and lower fabric bags covering said upper and lower petal baskets, respectively, and extending over the inner and outer surfaces of the petal leaves thereof; and (e) upper and lower flexible conically-shaped liners formed of an impermeable material inside said respective bags and interposed between the inner surfaces of said petal leaves and the conforming portions of said bags;

6. The combination of claim 5 wherein said liners are formed of an adhesion resistant material.

7. The combination of claim 6 wherein said liners are formed of a fiber glass fabric coated with polytetrafluoroethylene.

8. The combination of claim 5 wherein said upper fabric bag is formed of a water permeable material and said upper liner converges downwardly to said vent tube and is secured about said vent tube at the inner portion of said upper liner.

* * * * *